US008439476B2

(12) United States Patent
Ito et al.

(10) Patent No.: US 8,439,476 B2
(45) Date of Patent: May 14, 2013

(54) METHOD OF ADJUSTING OPTICAL AXIS OF INK DROPLET DETECTING DEVICE, METHOD OF ASSEMBLING INK DROPLET DETECTING DEVICE, AND APPARATUS FOR ADJUSTING OPTICAL AXIS

(75) Inventors: Kazumasa Ito, Aichi (JP); Hirotaka Hayashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 198 days.

(21) Appl. No.: 13/127,679

(22) PCT Filed: Nov. 2, 2009

(86) PCT No.: PCT/JP2009/068775

§ 371 (c)(1),
(2), (4) Date: May 4, 2011

(87) PCT Pub. No.: WO2010/053071

PCT Pub. Date: May 14, 2010

(65) Prior Publication Data

US 2011/0227989 A1 Sep. 22, 2011

(30) Foreign Application Priority Data

Nov. 4, 2008 (JP) ..... 2008-283059

(51) Int. Cl.
*B41J 29/393* (2006.01)

(52) U.S. Cl.
USPC ..... 347/19; 347/14; 347/5

(58) Field of Classification Search ..... 347/5, 9, 347/14, 19
See application file for complete search history.

(56) References Cited

U.S. PATENT DOCUMENTS

| | | | | |
|---|---|---|---|---|
| 6,641,246 | B2 * | 11/2003 | Endo et al. | 347/19 |
| 6,918,644 | B2 * | 7/2005 | Aruga | 347/9 |
| 2001/0043245 | A1 | 11/2001 | Endo et al. | |
| 2004/0169693 | A1 | 9/2004 | Nakamura | |

FOREIGN PATENT DOCUMENTS

| | | |
|---|---|---|
| JP | 2002-144597 | 5/2002 |
| JP | 3509706 | 3/2004 |
| JP | 2004-209460 | 7/2004 |
| JP | 2007-331158 | 12/2007 |

* cited by examiner

*Primary Examiner* — Lam S Nguyen
(74) *Attorney, Agent, or Firm* — McDermott Will & Emery LLP

(57) ABSTRACT

After a light emitting element holder is rotated, it is detected from the output value of a position adjusting light receiving element that a light beam formed by light emitted from a light emitting element is incident on a positioning target provided in a light emitting element. The light emitting element holder is duly fixed to a base member. When the incidence of the light beam on the positioning target is not detected from the output value of the position adjusting light receiving element even though the light emitting element holder is rotated, a light receiving element holder is made to slide for height adjustment and the light emitting element holder is rotated again. The adjustment of the height of the light receiving element holder and the adjustment of the rotation of the light emitting element holder are repeated until the light beam is incident on the positioning target.

8 Claims, 17 Drawing Sheets

METHOD OF ADJUSTING OPTICAL AXIS OF INK DROPLET DETECTING DEVICE, METHOD OF ASSEMBLING INK DROPLET DETECTING DEVICE, AND APPARATUS FOR ADJUSTING OPTICAL AXIS

RELATED APPLICATIONS

This application is the U.S. National Phase under 35 U.S.C. §371 of International Application No. PCT/JP2009/068775, filed on Nov. 2, 2009, which in turn claims the benefit of Japanese Application No. 2008-283059, filed on Nov. 4, 2008, the disclosures of which Applications are incorporated by reference herein.

FIELD

The present invention relates to a method of assembling an ink droplet detecting device that detects the discharge state of ink droplets from an ink droplet discharge head to an ink jet recording apparatus body, such as a printer, a copier, or a facsimile which records an image on a recording medium such as a sheet. In addition, the invention relates to a method of adjusting the optical axis of an ink droplet detecting device that adjusts an optical axis between a light emitting element and a light receiving element of the ink droplet detecting device. Further, the invention relates to an optical axis adjusting device that adjusts an optical axis using the optical axis adjusting method.

BACKGROUND

For example, Patent Literature 1 discloses this kind of ink jet recording apparatus. Patent Literature 1 discloses an ink droplet detecting device in which a light emitting module and a light receiving module are fixed to a base member, the angle of the light emitting module can be adjusted in the vertical direction, and the movement of the light receiving module can be adjusted in the horizontal direction, so that the optical axis is adjusted. In the ink droplet detecting device, ink droplets are sequentially discharged from an ink droplet discharge head while the ink droplet discharge head is moved, a laser beam is emitted from the light emitting module so as to collide with the flying ink droplet, and the discharge state of the ink droplet, such as a discharge failure or deflection, is detected from a variation in the amount of light received by the light receiving module.

In the ink jet recording apparatus disclosed in Patent Literature 1, after the ink droplet detecting device is assembled to the recording apparatus body, the optical axis between the light emitting element and the light receiving element of the ink droplet detecting device is adjusted.

CITATION LIST

Patent Literature

Patent Literature 1: Japanese Patent No. 3509706

SUMMARY

Technical Problem

However, it is considered that the accuracy of two-dimensional positioning between the ink droplet detecting device and the recording apparatus body needs to be ensured in order to discharge the ink droplets from each nozzle of the ink droplet discharge head while the ink droplet discharge head is moving so that the discharge timing is synchronized with the emission timing of laser beam whose optical axis is inclined by 26 degrees and to hit the flying ink droplet with the laser beam emitted from a light-emitting side. In the adjustment of the parallelism between the optical axis of the ink droplet detecting device and a nozzle row of the ink droplet discharge head, the position of the light emitting module in the vertical direction is adjusted such that the degree of inclination does not vary. However, the positional relationship between the ink droplet detecting device including the light receiving module and the nozzle row of the ink droplet discharge head is not considered.

In the ink jet recording apparatus disclosed in Patent Literature 1, after the ink droplet detecting device is assembled to the recording apparatus body, the optical axis between the light emitting element and the light receiving element is adjusted. Therefore, it is not easy to adjust the optical axis.

A first object of the invention is to facilitate the adjustment of the optical axis in an ink droplet detecting device.

A second object of the invention is to provide a structure for easily maintaining the parallelism between the optical axis of an ink droplet detecting device and a nozzle row of an ink droplet discharge head of an ink jet recording apparatus body.

Solution to Problem

According to one aspect of the present invention, provided is a method of adjusting the optical axis of an ink droplet detecting device including a light emitting element that emits light, a light emitting element holder that holds the light emitting element, a light receiving element for detecting an ink droplet discharge failure that receives scattered light after a light beam formed by the light emitted from the light emitting element collides with an ink droplet, a light receiving element holder that holds the light receiving element for detecting a discharge failure, and a base member to which the light emitting element holder and the light receiving element holder are preliminarily positioned by a light-reception-side holder shaft portion of the light receiving element holder and a light-emission-side holder shaft portion of the light emitting element holder and then fixed, the light emitting element holder being held to the base member such that the rotation of the light emitting element holder about the light-emission-side holder shaft portion can be adjusted and the light receiving element holder being held to the base member such that the sliding of the light receiving element holder in the axial direction of the light-reception-side holder shaft portion perpendicular to a direction in which the rotation of the light emitting element holder is adjusted can be adjusted.

In such method of adjusting the optical axis, (1) the ink droplet detecting device is positioned with the light-emission-side holder shaft portion and the light-reception-side holder shaft portion and fixed to an optical axis adjusting device;

(2) power is supplied to turn on the emission of the light emitting element and a detecting circuit of a position adjusting light receiving element;

(3) the light emitting element holder is rotated and it is detected that the light beam formed by the light which is emitted from the light emitting element is incident on a positioning target provided in the light receiving element for detecting a discharge failure, from an output value of the position adjusting light receiving element;

(4) the light emitting element holder is duly fixed to the base member; and (5) when the incidence of the light beam on the positioning target is not detected from the output value of the position adjusting light receiving element even though the light emitting element holder is rotated, the light receiving element holder is made to slide to adjust the height of the light receiving element holder, the light emitting element holder is rotated again, and the adjustment of the height of the light receiving element holder and the adjustment of the rotation of the light emitting element holder are repeated until the light beam is incident on the positioning target.

According to another aspect of the present invention, after the light emitting element holder is duly fixed to the base member, (6) the detecting circuit of the light receiving element for detecting a discharge failure may be turned on, the light receiving element holder may slide such that the height thereof is adjusted, and it may be determined whether the output value of the light receiving element for detecting a discharge failure is an appropriate value, (7) when the output value is the appropriate value, the light receiving element holder may be duly fixed to the base member, and (8) when the output value is not the appropriate value, the light receiving element holder may slide again such that the height thereof is adjusted, and the adjustment of the height of the light receiving element holder may be repeated until the output value of the light receiving element for detecting a discharge failure is the appropriate value.

According to still another aspect of the present invention, the light receiving element for detecting a discharge failure may be used as the position adjusting light receiving element, and a light shielding shape that covers the light receiving element for detecting a discharge failure and prevents the light emitted from the light emitting element from being directly incident on the light receiving element for detecting a discharge failure may be formed as the positioning target on a vertical plane of the light receiving element holder which passes through the center axis of the light receiving element for detecting a discharge failure.

According to still another aspect of the present invention, the light receiving element for detecting a discharge failure is used as the position adjusting light receiving element, and a light transmitting shape that transmits the light emitted from the light emitting element so as to be directly incident on the light receiving element for detecting a discharge failure is formed as the positioning target on a vertical plane of the light receiving element holder which passes through the center axis of the light receiving element for detecting a discharge failure.

According to still another aspect of the present invention, the positioning target a reflecting surface that is provided on the vertical plane of the light receiving element holder passing through the center axis of the light receiving element for detecting a discharge failure, and the position adjusting light receiving element that receives light which has been emitted from the light emitting element and then reflected from the reflecting surface may be is provided in the optical axis adjusting device separately from the light receiving element for detecting a discharge failure.

According to still another aspect of the present invention, provided is a method of assembling an ink droplet detecting device including:

inserting a light-emission-side holder shaft portion and a light-reception-side holder shaft portion into shaft holes of an ink jet recording apparatus body and positioning the ink droplet detecting device; and assembling to the recording apparatus body, the ink droplet detecting device whose optical axis is adjusted using the optical axis adjusting method according to any one of the aspects of the present invention.

According to still another aspect of the present invention, provided is an apparatus for adjusting the optical axis of an ink droplet detecting device including a light emitting element that emits light, a light emitting element holder that holds the light emitting element, a light receiving element for detecting an ink droplet discharge failure that receives scattered light after the light emitted from the light emitting element collides with an ink droplet, a light receiving element holder that holds the light receiving element for detecting a discharge failure, and a base member to which the light emitting element and the light receiving element for detecting a discharge failure are positioned by a light-reception-side holder shaft portion of the light receiving element holder and a light-emission-side holder shaft portion of the light emitting element holder and then fixed, the light emitting element holder being held to the base member such that the rotation of the light emitting element holder about the light-emission-side holder shaft portion can be adjusted and the light receiving element holder being held to the base member such that the sliding of the light receiving element holder in the axial direction of the light-reception-side holder shaft portion perpendicular to a direction in which the rotation of the light emitting element holder is adjusted can be adjusted.

Such apparatus for adjusting the optical axis includes:

an installation position where the ink droplet detecting device is positioned by the light-emission-side holder shaft portion and the light-reception-side holder shaft portion and is fixed;

a rotation adjusting jig that adjusts the rotation of the light emitting element holder about the light-emission-side holder shaft portion relative to the base member;

a vertical adjustment jig that adjusts the sliding of the light receiving element holder relative to the base member in the axial direction of the light-reception-side holder shaft portion perpendicular to the direction in which the rotation of the light emitting element holder is adjusted; and a position adjusting light receiving element which detects that the light emitted from the light emitting element after the light emitting element holder is rotated is incident on a positioning target provided in the light receiving element from an output value.

According to still another aspect of the present invention, the apparatus for adjusting the optical axis of an ink droplet detecting device may include.

a control unit that controls one or both of the rotation adjusting jig and the vertical adjustment jig on the basis of the output value of the position adjusting light receiving element.

Advantageous Effects of Invention

According to one aspect of the present invention, before the ink droplet detecting device is assembled to the ink jet recording apparatus body, it is possible to adjust the angle of the optical axis between the light emitting element and the light receiving element of the ink droplet detecting device and facilitate the adjustment of the optical axis of the ink droplet detecting device. It is possible to automatically adjust the optical axis of the ink droplet detecting device and improve work efficiency.

According to one aspect of the present invention the light-emission-side and light-reception-side holder shaft portions are inserted into the shaft holes of the ink jet recording apparatus body and are positioned. The ink droplet detecting device whose optical axis is adjusted is assembled to the recording apparatus body by the optical axis adjusting method according to any one of the aspects of the present invention. Therefore, it is not necessary to adjust the optical axis when the ink droplet detecting device is attached to the recording apparatus body and it is possible to accurately attach the ink droplet detecting device. In addition, it is possible to maintain the parallelism between the optical axis of the ink droplet detecting device after the angle of the optical axis is adjusted and the nozzle row of the ink droplet discharge head of the recording apparatus body. Therefore, it is possible to improve the detection performance while improving assembleability.

According to one aspect of the present invention, the use of the optical axis adjusting device makes it possible to adjust the angle of the optical axis between the light emitting element and the light receiving element of the ink droplet detecting device before the ink droplet detecting device is assembled to the ink jet recording apparatus body, and it is possible to facilitate the adjustment of the optical axis of the ink droplet detecting device. It is possible to automatically adjust the optical axis of the ink droplet detecting device and improve work efficiency.

DESCRIPTION OF EMBODIMENTS

Figure 1A:
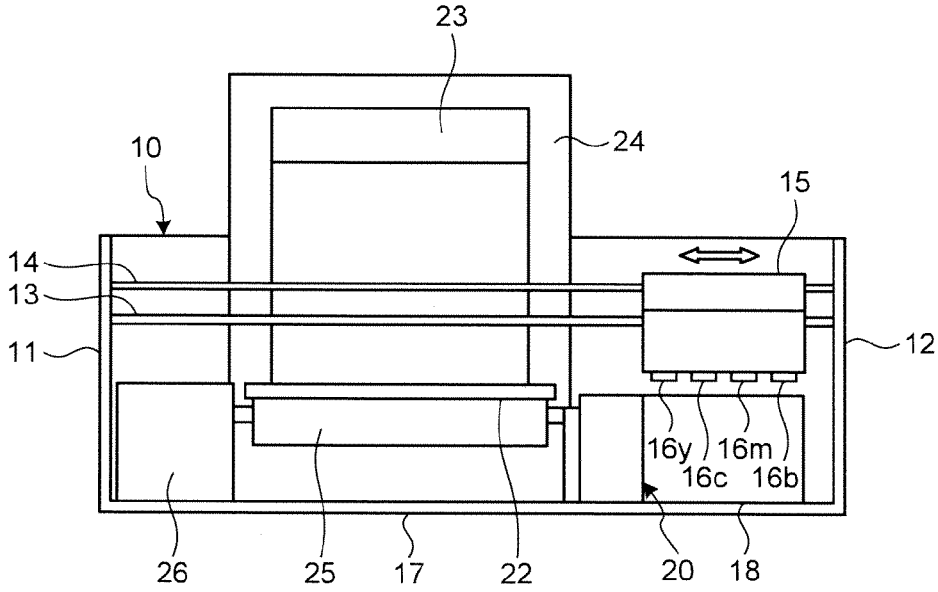
FIG. 1A is a front view schematically illustrating an ink jet printer.
Figure 1B:
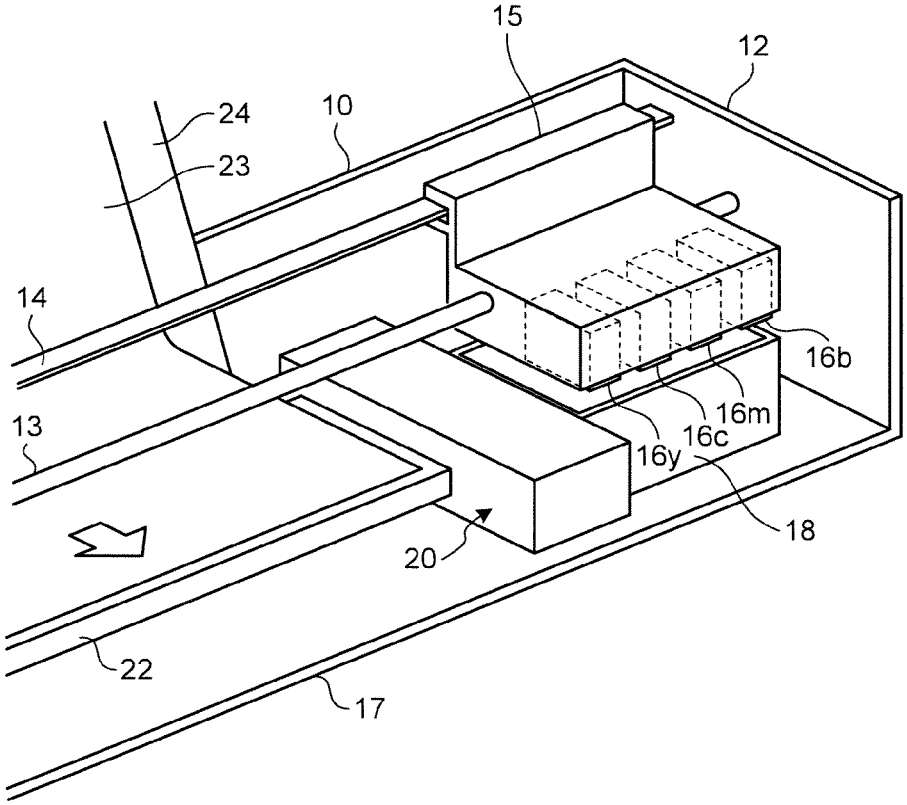
FIG. 1B is a partial perspective view schematically illustrating a portion of the ink jet printer, as viewed from the upper side.

Hereinafter, exemplary embodiments of the invention will be described with reference to the accompanying drawings. FIG. 1A is a diagram illustrating an ink jet printer, as viewed from the front side. FIG. 1B is a diagram illustrating the ink jet printer, as obliquely viewed from the upper side.

In FIGS. 1A and 1B, reference numeral 10 indicates a housing. A guide shaft 13 and a guide plate 14 are provided in parallel between left and right plates 11 and 12 of the housing 10. The guide shaft 13 and the guide plate 14 support a carriage 15. An endless belt (not shown) is attached to the carriage 15. The endless belt is wound around a driving pulley and a driven pulley (not shown) that are provided on the left and right sides of the housing 10. When the driving pulley is rotated, the driven pulley is rotated and the endless belt is rotated. In this way, the carriage 15 can be moved in the horizontal direction as represented by an arrow in FIG. 1A.

Yellow, cyan, magenta, and black ink droplet discharge heads 16*y*, 16*c*, 16*m*, and 16*b* are provided in the carriage 15 in parallel to the moving direction of the carriage 15. Each ink droplet discharge head 16 includes nozzle rows of a plurality of nozzles arranged in a straight line in the nozzle plane facing downward. Although not shown in the drawings, for example, two nozzle rows are provided in a direction perpendicular to the moving direction of the carriage 15.

When the carriage 15 is disposed at the right end, which is a home position, of FIGS. 1A and 1B, each ink droplet discharge head 16 faces an independent recovery device 18 that is provided on a bottom plate 17 in the housing 10. The independent recovery device 18 draws ink from a nozzle for which an ink droplet detecting device 20 detects the ink droplet discharge failure, whereby the ink jet printer recovers from the liquid discharge failure by itself.

The ink droplet detecting device 20 is provided on the bottom plate 17 in the vicinity of the independent recovery device 18 in the housing 10 so as be elongated in a direction perpendicular to the moving direction of the carriage 15. The ink droplet detecting device 20 will be described in detail with reference to FIG. 2 and the subsequent figures.

A plate-shaped platen 22 is provided adjacent to the ink droplet detecting device 20. A feed tray 24 that feeds a sheet 23, which is a recording medium, onto the platen 22 is obliquely provided on the rear side of the platen 22. Although not shown in the drawings, a feed roller that feeds the sheet 23 on the feed tray 24 onto the platen 22 is provided. In addition, a transport roller 25 that transports the sheet 23 on the platen 22 to the front side in the direction of an arrow is provided.

A driving device 26 is provided at the left end on the bottom plate 17 in the housing 10. The driving device 26 drives, for example, the feed roller (not shown) or the transport roller 25 and drives the driving pulley to rotate the endless belt, thereby moving the carriage 15.

During recording, the sheet 23 is moved onto the platen 22 by the driving device 26 and is disposed at a predetermined position. In addition, the carriage 15 is moved to scan the sheet 23. In this case, the four color ink droplet discharge heads 16*y*, 16*c*, 16*m*, and 16*b* sequentially discharge ink droplets from the nozzles onto the sheet 23 while being moved in the left direction, thereby recording an image on the sheet 23. After the image is recorded, the carriage 15 returns in the right direction and the sheet 23 is transported a predetermined distance in the direction of an arrow in FIG. 1B.

Figure 2:
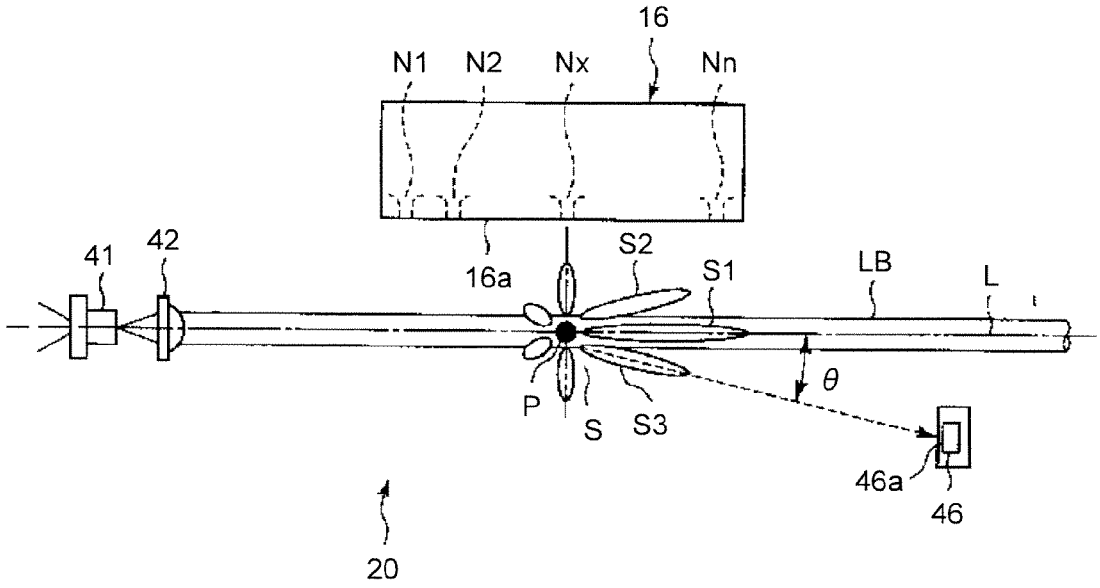
FIG. 2 is a diagram illustrating an ink droplet discharge head and an ink droplet detecting device provided in the ink jet printer shown in FIG. 1A.

Then, the four color ink droplet discharge heads 16*y*, 16*c*, 16*m*, and 16*b* sequentially discharge ink droplets from the nozzles onto the sheet 23 while the carriage 15 is moved in the left direction again, thereby recording an image on the sheet 23. Similarly, after the image is formed, the carriage 15 returns in the right direction and the sheet 23 is transported a predetermined distance in the direction of the arrow in FIG. 1B. This operation is repeated to record an image on one sheet 23. FIG. 2 is a diagram illustrating the ink droplet discharge head 16 and the ink droplet detecting device 20 provided in the ink jet printer shown in FIG. 1A.

The ink droplet discharge head 16 shown in FIG. 2 includes a head nozzle plane 16*a* that faces downward. A nozzle row of a plurality of nozzles N1, N2, . . . , Nx, . . . , Nn arranged in a straight line is formed on the head nozzle plane 16*a*. Ink droplets P, which are liquid droplets, are selectively discharged from the nozzles.

The ink droplet detecting device 20 detects the discharge failure of the ink droplets P from the nozzles N1, N2, . . . , Nx, . . . , Nn of the ink droplet discharge head 16. The ink droplet detecting device 20 shown in FIG. 2 includes, for example, a light emitting element 41 that emits light, a collimator lens 42 that changes the light emitted from the light emitting element 41 into a light beam LB, which is parallel light, and a light receiving element 46 for detecting a discharge failure that receives light emitted from the light emitting element 41.

The ink droplet detecting device 20 is provided in a direction intersecting the direction in which the ink droplets are discharged such that the light beam LB collides with the flying ink droplet P which is discharged from the head nozzle plane 16*a*. In addition, the ink droplet detecting device 20 is provided such that the optical axis L of the light beam LB is parallel to the nozzle row at a predetermined distance away from the head nozzle plane 16*a*.

In this embodiment, the light receiving element 46 is arranged at a position which is inclined downward at an angle θ with respect to the optical axis L of the light beam LB such that a light receiving surface 46*a* is disposed at a position out of the diameter of the light beam LB having an elliptical shape in a cross-sectional view.

When the ink droplet P is discharged from the nozzle Nx of the head nozzle plane 16*a* and the light beam LB collides with the ink droplet P, scattered light S is generated. In the scattered light S, in particular, forward-scattered light S3 is received by the light receiving surface 46*a* of the light receiving element 46 and the output of the light receiving element 46 is measured as a voltage value (light output value). In this way, data of the received light is obtained and the discharge of the ink droplet P and a liquid discharge failure, such as deflection, are detected from a variation in the output of the light receiving element 46.

Figure 3:
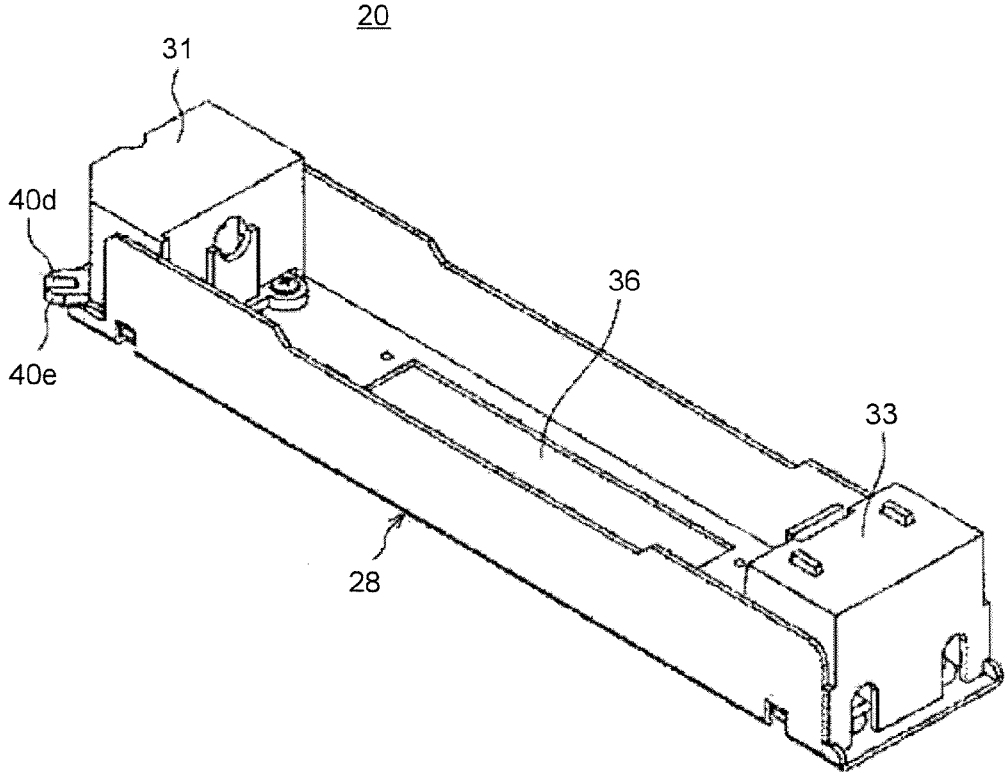
FIG. 3 is a diagram illustrating the outward appearance of the ink droplet detecting device.
Figure 4:
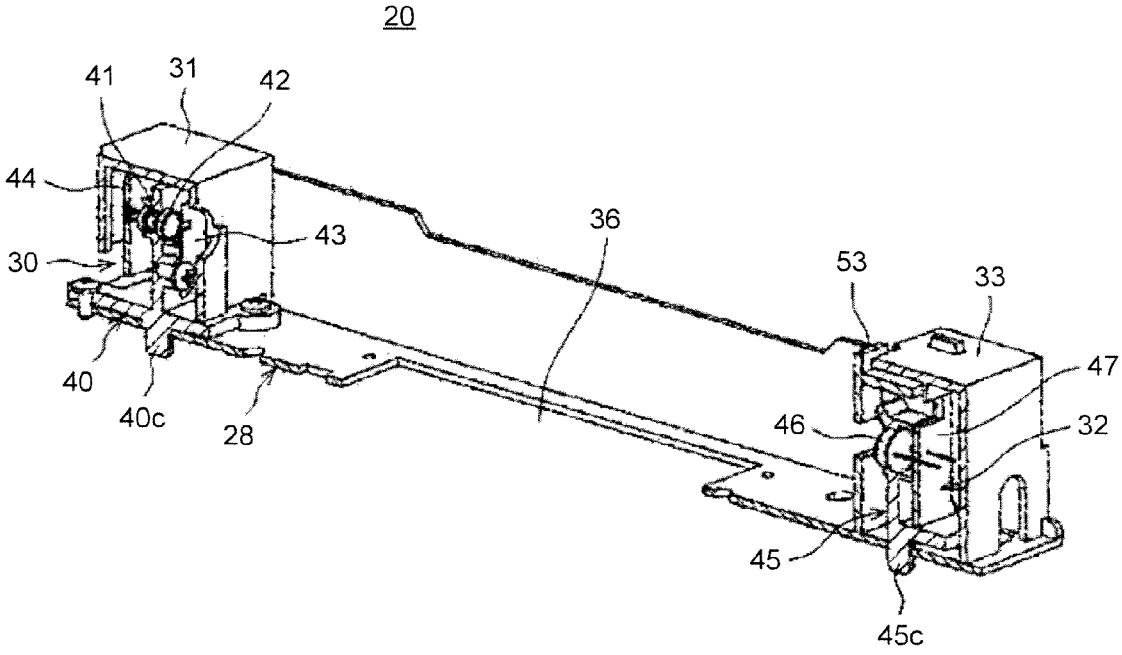
FIG. 4 shows a longitudinal cross section of the ink droplet detecting device along the length direction.

FIG. 3 is a diagram illustrating the outward appearance of the ink droplet detecting device 20. FIG. 4 is a diagram illustrating the longitudinal section of the ink droplet detecting device 20 in the length direction. As shown in FIGS. 3 and 4, the ink droplet detecting device 20 includes a base member 28 having a U-shape in a longitudinal cross-sectional view in which both ends of an elongated plate are bent. A light emitting module 30 is provided at one end of the base member in the length direction so as to be covered with a light-emission-side module cover 31. In addition, a light receiving module 32 is provided at the other end of the base member in the length direction so as to be covered with the light-reception-side module cover 33.

Figure 5:
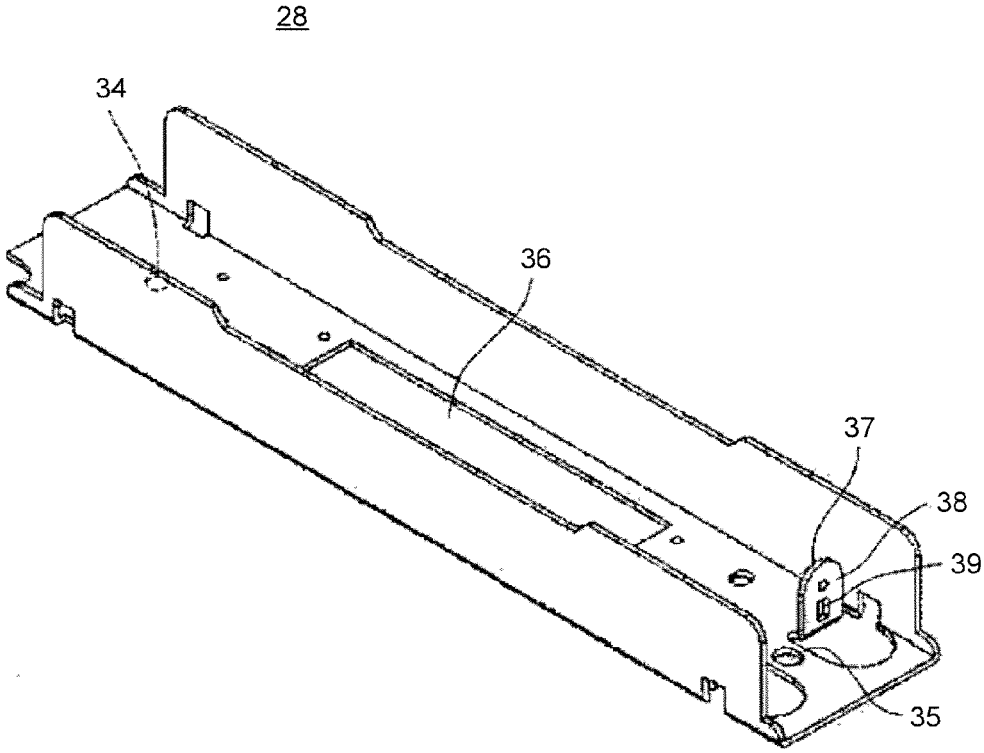
FIG. 5 is a perspective view illustrating a base member of the ink droplet detecting device.

FIG. 5 is a diagram illustrating the base member 28. A light-emission-side positioning hole 34 having a circular shape is provided on the light emission side of the base member 28 and a light-reception-side positioning hole 35 that has an oval shape with the major axis extending to the light emission side is provided on the light reception side of the base member 28. A rectangular opening 36 that is elongated in the length direction is provided between the positioning holes 34 and 35. Vertically bent pieces 37 that are bent along a folding line in the width direction are provided on both sides of the light-reception-side positioning hole 35 in the width direction. An external surface of the vertically bent piece 37 is a guide surface 38 and a guide groove 39 is provided in the guide surface in the longitudinal direction.

Figure 6:
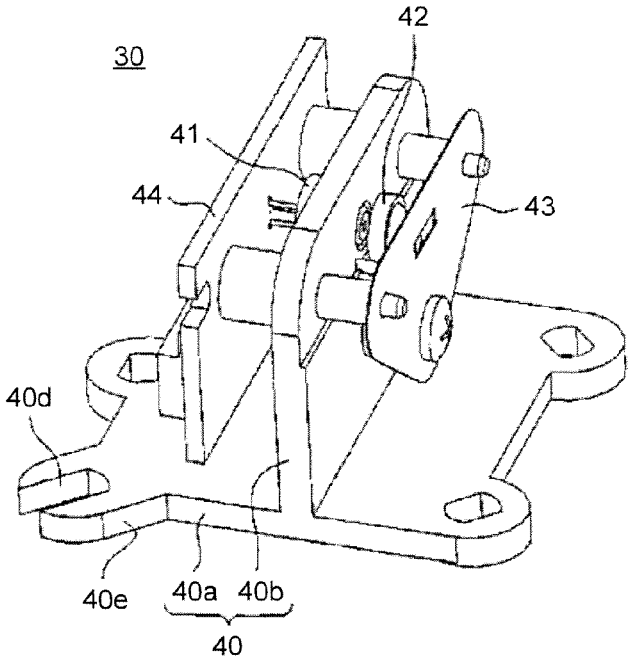
FIG. 6 is a perspective view illustrating a light emitting module attached to the base member.

FIG. 6 is a diagram illustrating the light emitting module 30. The light emitting module 30 has a structure in which, for example, a light emitting element 41, a collimator lens 42, an aperture 43, and a circuit board 44 are attached to a light emitting element holder 40. The light emitting element holder 40 includes a rectangular bottom plate portion 40*a* and a vertical plate portion 40*b* that vertically rises from the center position of the rectangular bottom plate portion 40*a* and is formed in an inverted T shape in a three-dimensional view. A light-emission-side holder shaft portion 40*c* is provided on the bottom plate portion 40*a* so as to protrude downward from the center of the bottom (see FIG. 4 and FIG. 9 which will be described below). A protruding portion 40*e* having a jig fitting portion 40*d* which is a groove formed in the diagonal direction is formed at one corner of the bottom plate portion 40*a*. For example, the light emitting element 41, the collimator lens 42, the aperture 43, and the circuit board 44 are attached to the vertical plate portion 40*b*.

Figure 7:
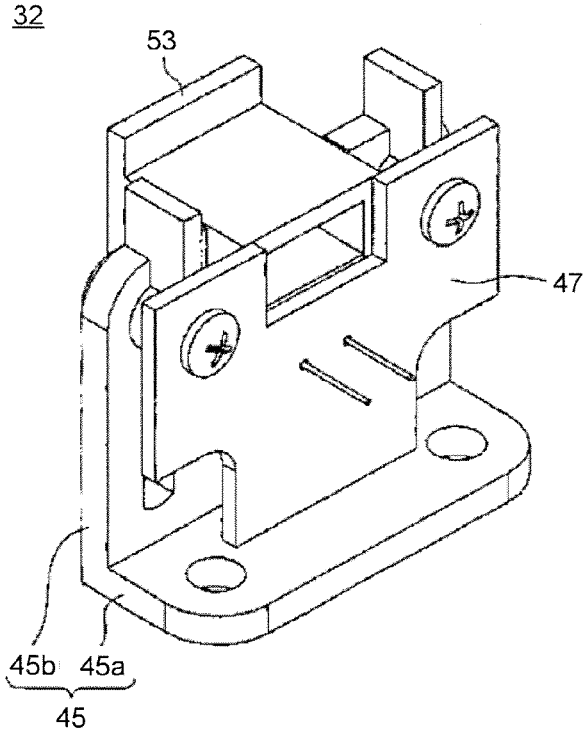
FIG. 7 is a perspective view illustrating a light receiving module attached to the base member.

FIG. 7 is a diagram illustrating the light receiving module 32. The light receiving module 32 has a structure in which, for example, a light receiving element 46 (see FIG. 4) and a circuit board 47 are attached to a light receiving element holder 45 for detecting a discharge failure. The light receiving element holder 45 includes a bottom plate portion 45*a*, which is an elongated plate, and a vertical plate portion 45*b* that vertically rises from the long side of the bottom plate portion 45*a* and is formed in an L shape in a three-dimensional shape. A light-reception-side holder shaft portion 45*c* is provided on the bottom plate portion 45*a* so as to protrude downward from the bottom (see FIG. 4 and FIG. 9 which will be described below). For example, the light receiving element 46 and the circuit board 47 are attached to the vertical plate portion 45*b*. An external surface of the vertical plate portion 45*b* is a sliding surface 45*d* that is parallel to the shaft center of the light-reception-side holder shaft portion 45*c*, and a guide protrusion 45*e* is formed on the sliding surface 45*d* (see FIG. 9 which will be described below).

Figure 8:
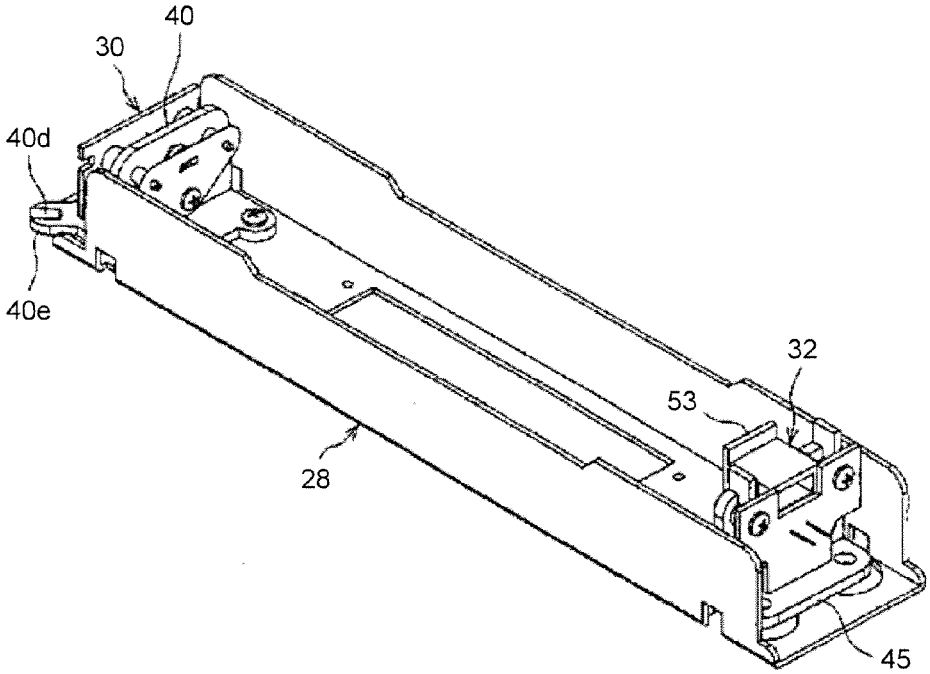
FIG. 8 is a perspective view illustrating the attachment of the two modules to the base member.
Figure 9:
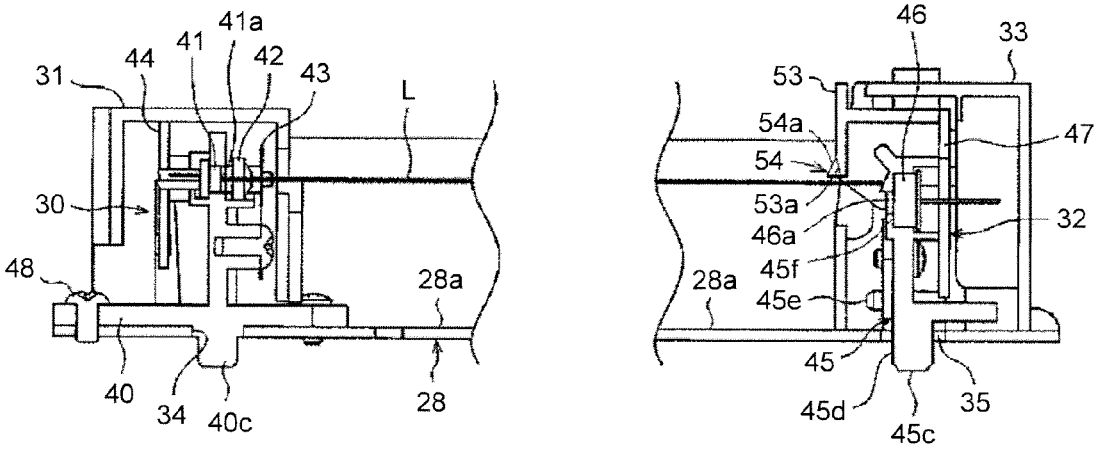
FIG. 9 is an enlarged longitudinal cross-sectional view illustrating each module attachment portion.

FIG. 8 is a diagram illustrating the attachment of the light emitting module 30 and the light receiving module 32 to the base member 28. FIG. 9 is a diagram illustrating the enlarged cross section of each module attachment portion. In the light emitting module 30, the light-emission-side holder shaft portion 40*c* is fitted to the light-emission-side positioning hole 34 that is formed at a positioning position of the base member 28 and is disposed on a receiving surface 28*a* of the base member 28, and the light emitting element holder 40 is attached to the base member 28 such that the rotation thereof can be adjusted. After rotation is adjusted, a plurality of fastening members 48 is fastened to fix the light emitting module 30 to the base member 28. In this way, the focus of the light emitting element 41 and the collimator lens 42 on the optical axis L of the light beam LB is adjusted in order to obtain a desired beam diameter and then the light emitting element 41 and the collimator lens 42 are fixed in parallel to the receiving surface 28*a*. In addition, in order to cut flare light of the beam, the aperture 43 is arranged in front of the collimator lens 42. The light emitting module 30 is covered by the module cover 31.

Figure 10:
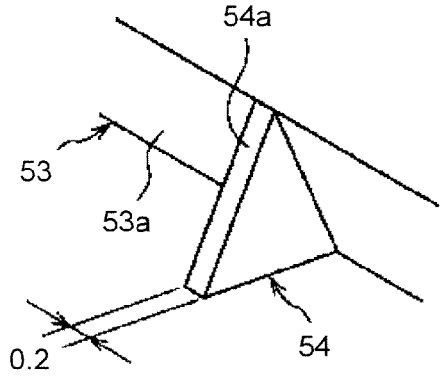
FIG. 10 is an enlarged perspective view illustrating a positioning target formed in a light guide cover of the light receiving module.

In the light receiving module 32, the light-reception-side holder shaft portion 45*c* is fitted to the light-reception-side positioning hole 35 that is formed at a positioning position of the base member 28, and the light receiving element holder 45 is attached to the base member 28 such that it can slide in the vertical direction. The light receiving element holder 45 includes a cut-out portion 45*f* that is formed around the light receiving surface 46*a* of the light receiving element 46 for detecting a discharge failure. A light guide cover 53 is integrally attached to the light receiving element holder 45. For example, as shown in FIG. 10, a positioning target 54 is formed in the light guide cover 53. The light receiving module 32 is covered by the light-reception-side module cover 33.

FIG. 10 is an enlarged view illustrating the positioning target 54 formed in the light guide cover 53.

As can be seen from FIG. 10, the positioning target 54 is formed with a small width of about 0.2 mm on a vertical plane (see reference numeral F in FIG. 13), which passes through the center axis of the light receiving element 46 for detecting a discharge failure, of a downward-inclined surface 53*a* of the light guide cover 53 integrally attached to the light receiving element holder 45 so as to protrude therefrom. A top surface that is inclined upward is a reflecting surface 54*a*.

As can be seen from FIG. 9, a light emitting point 41*a* of the light emitting element 41 is provided on the shaft center of the light-emission-side holder shaft portion 40*c*. In this way, the light emitting element holder can be rotated about the light emitting point 41*a* of the optical axis L, the positional deviation of the light emitting point 41*a* is minimized, and it is possible to adjust the angle of the optical axis considering the accuracy of positioning. The shaft center of the light-reception-side holder shaft portion 45*c* is provided in parallel to the light receiving surface 46*a* of the light receiving element 46. In this way, the light receiving element holder can be moved in the vertical direction and it is possible to fix the light receiving element holder to the base member 28 such that the optical axis L is aligned with the center of the light receiving element 46. The light-reception-side holder shaft portion 45*c* is disposed on the vertical plane F, which will be described below.

In the ink droplet detecting device 20, before rotation is adjusted, the light emitting element holder 40 of the light emitting module 30 is preliminarily fastened to the base member 28 by the fastening members 48 with fastening force such that it can be rotated. In this state, first, as shown in FIG. 11, the ink droplet detecting device 20 is positioned by the light-emission-side holder shaft portion 40*c* and the light-reception-side holder shaft portion 45*c* and is fixed to an optical axis adjusting device 55 (see Step S1 of FIG. 15 which will be described below).

Figure 11:
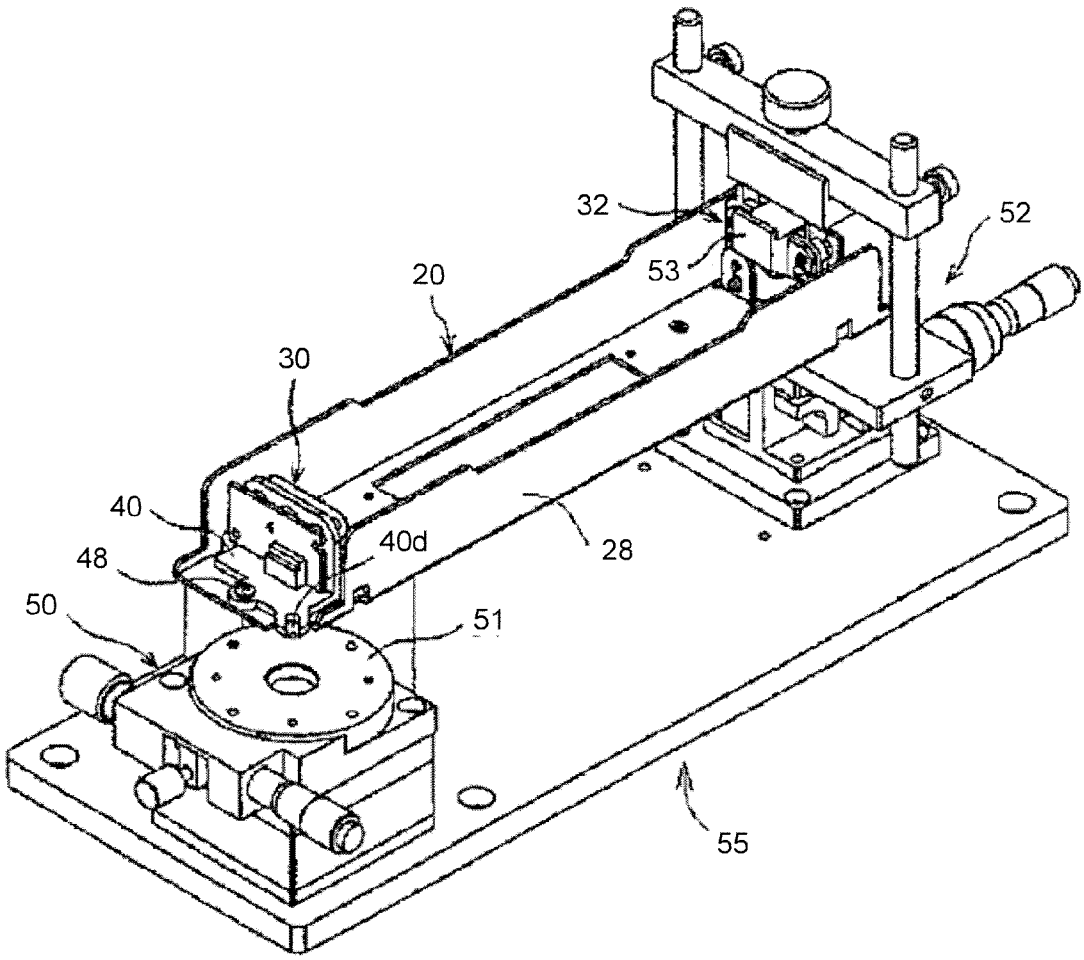
FIG. 11 is a diagram illustrating the fixation of the ink droplet detecting device to an optical axis adjusting device.

FIG. 11 is a diagram illustrating the fixation of the ink droplet detecting device 20 to the optical axis adjusting device 55. In FIG. 11, both the light-emission-side and light-reception-side module covers 31 and 33 are removed. However, adjustment can be performed while the module covers 31 and 33 are placed at the position, because, for example, on the light emission side, a fastening member through hole and the jig fitting portion 40*d* of the light emitting element holder 40 are arranged to be exposed outside the module cover 31. A convex portion of a rotation adjusting jig 50 is fitted to the groove-shaped jig fitting portion 40*d* of the light emitting element holder 40. A rotating body 51 of the rotation adjusting jig 50 is rotated to adjust the rotation of the light emitting element holder 40 about the light-emission-side holder shaft portion 40*c* fitted to the light-emission-side positioning hole 34. In this way, it is possible to rotate the light beam LB emitted from the light emitting element 41 in the horizontal direction.

The optical axis adjusting device 55 includes an attachment position where the ink droplet detecting device 20 is positioned by the light-emission-side holder shaft portion 40*c* and the light-reception-side holder shaft portion 45*c* and is then attached, the rotation adjusting jig 50 that adjusts the rotation of the light emitting element holder 40 about the light-emission-side holder shaft portion 40*c* relative to the base member 28, a vertical adjustment jig 52 that adjusts the sliding of the light receiving element holder 45 relative to the base member 28 in the axial direction of the light-reception-side holder shaft portion 45*c* perpendicular to the direction in which the rotation of the light emitting element holder 40 is adjusted, and a position adjusting light receiving element (see reference numeral 56 of FIGS. 12A and 12B) that detects, as an output value, the incidence of light, which is emitted from the light emitting element 41 after the light emitting element holder 40 is rotated, on the positioning target 54 provided in the light receiving element 46 for detecting a discharge failure.

Figure 12A:
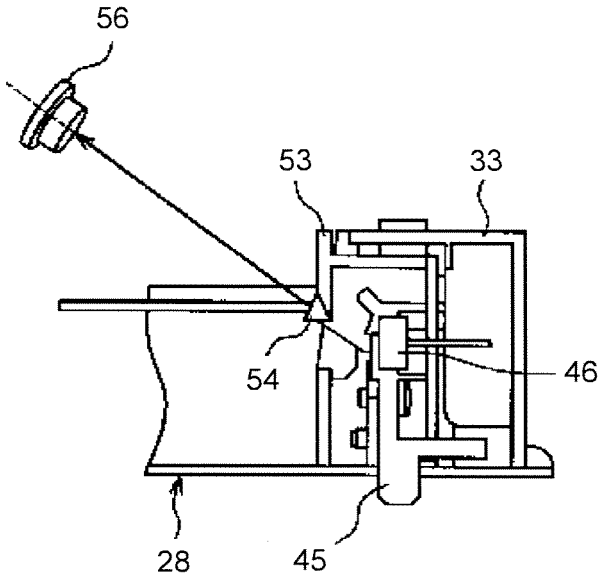
FIG. 12A is a diagram illustrating a state in which a light emitting element holder is rotated and light emitted from a light emitting element is incident on the positioning target.
Figure 12B:
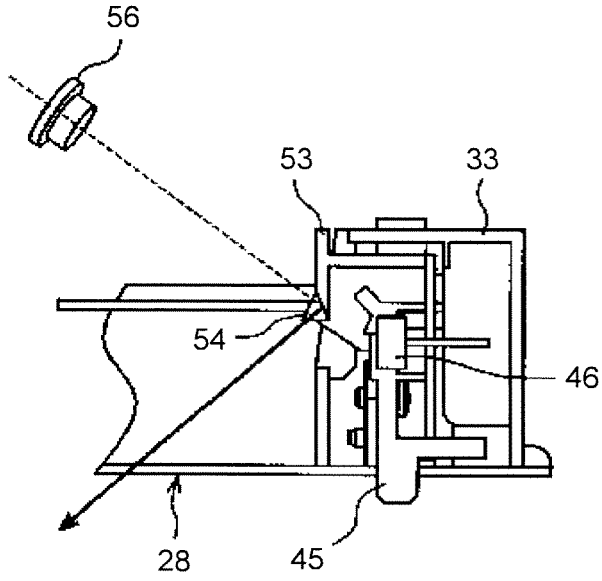
FIG. 12B is a diagram illustrating a state in which light emitted from the light emitting element is not incident on the positioning target.

FIG. 12A is a diagram illustrating a state in which the position adjusting light receiving element 56 detects the incidence of light, which is emitted from the light emitting element 41 after the light emitting element holder 40 is rotated, on the positioning target 54 provided in the light receiving element 46 for detecting a discharge failure. FIG. 12B is a diagram illustrating a state in which light emitted from the light emitting element 41 is not incident on the positioning target 54.

Figure 13:
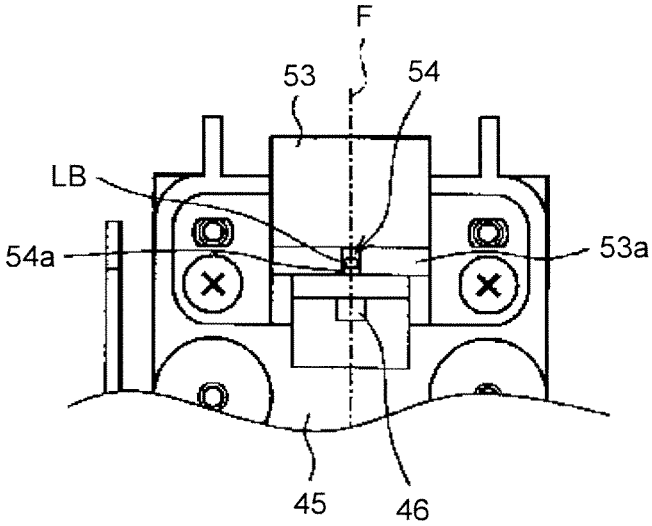
FIG. 13 is a diagram illustrating a light receiving module, as viewed from the light emitting module.

FIG. 13 is a diagram illustrating the light receiving module 32, as viewed from the light emitting module 30. As can be seen from FIG. 13, the positioning target 54 is formed with a small width on the vertical plane F, which passes through the center axis of the light receiving element 46 for detecting a discharge failure, on the downward-inclined surface 53*a* of the light guide cover 53 so as to protrude therefrom, and the top surface that is inclined upward is the reflecting surface 54*a*. As described above, the light-reception-side holder shaft portion 45*c* is provided on the vertical plane F. The light guide cover 53 is integrally attached to the light receiving element holder 45 that holds the light receiving element 46 for detecting a discharge failure and performs stray light processing on light that is incident and reflected from the cut-out portion 45*f* such that light is not incident on the light receiving element 46 again. The surface of the cut-out portion 45*f* has, for example, a mirror-finished surface.

Figure 14A:
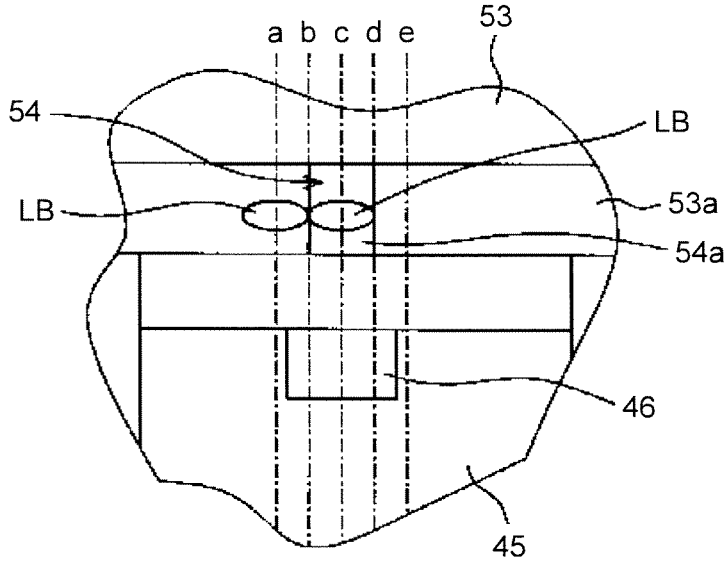
FIG. 14A is a diagram illustrating a variation in the incident position of a light beam LB from a to e on the light guide cover when the light emitting element is rotated in the horizontal direction.
Figure 14B:
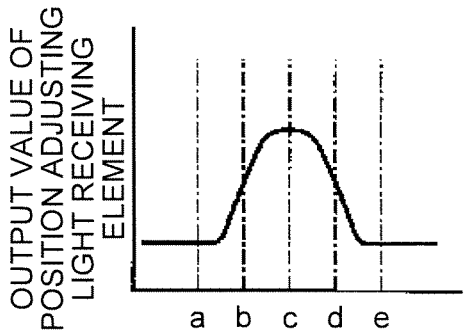
FIG. 14B is a diagram illustrating a variation in the output value of a position adjusting light receiving element at the positions a to e shown in FIG. 14A.

FIG. 14A is a diagram illustrating a variation in the incident position of the light beam LB on the light guide cover 53 from a to e when the light emitting element 41 is rotated in the horizontal direction. FIG. 14B is a diagram illustrating a variation in the output value of the position adjusting light receiving element 56 at the positions a to e. As can be seen from FIG. 14B, it is detected that the light beam LB is incident on the reflecting surface 54*a* of the positioning target 54 at the position c because the output value of the position adjusting light receiving element 56 is largest at the position c, and thus it is possible to adjust the optical axis of the light emitting element 41.

Figure 15:
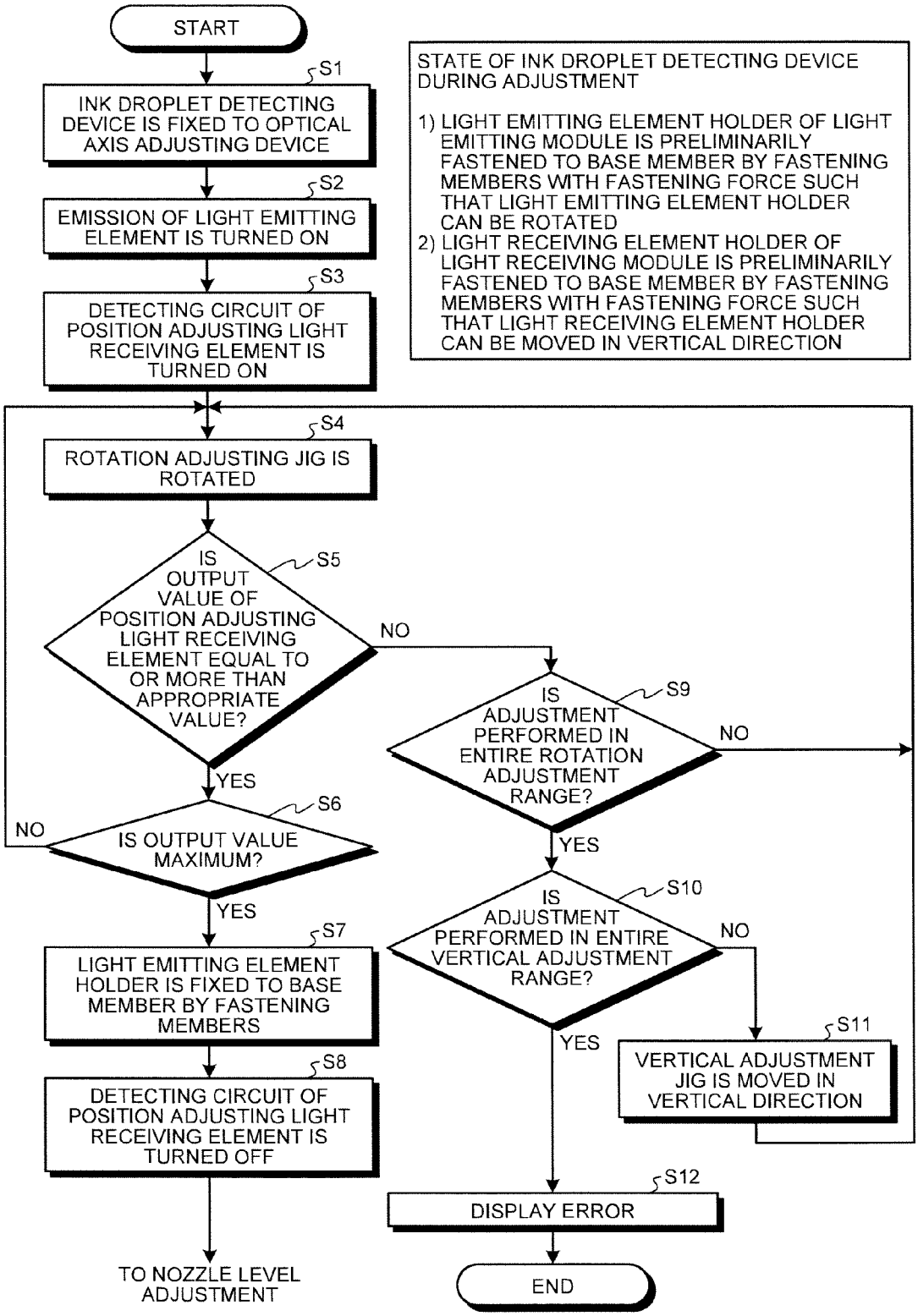
FIG. 15 is a flowchart illustrating a process of adjusting the optical axis of the light emitting element in the horizontal direction.

FIG. 15 is a flowchart illustrating the flow of a process of adjusting the optical axis of the light emitting element 41 in the horizontal direction. As described above, with the light emitting element holder 40 preliminarily fastened to the base member 28 by the fastening member 48, first, as shown in FIG. 11, the ink droplet detecting device 20 is positioned by the light-emission-side holder shaft portion 40*c* and the light-reception-side holder shaft portion 45*c* and is then fixed to the optical axis adjusting device 55 (see Step S1).

Figure 16:
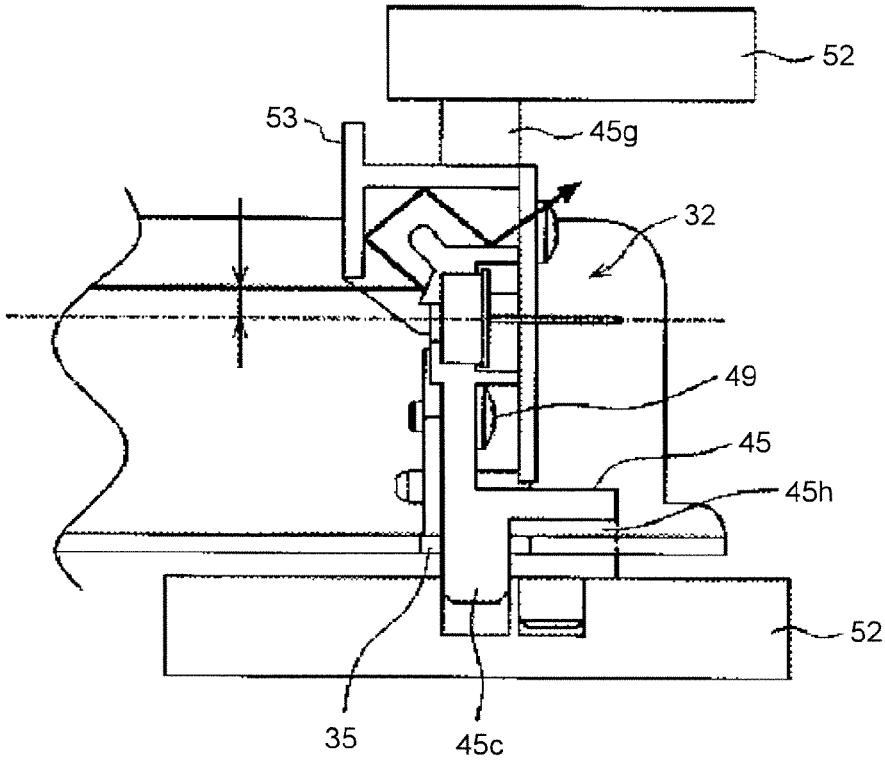
FIG. 16 is a diagram illustrating the attachment adjusted state of the light reception side, as viewed from the size perpendicular to the light beam.
Figure 17:
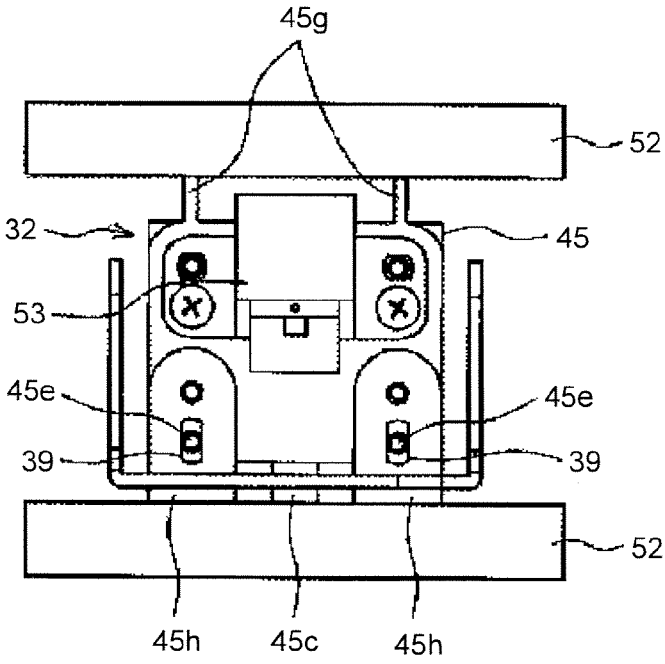
FIG. 17 is a diagram illustrating the attachment adjusted state of the light reception side, as viewed from the light emission side.

FIG. 16 is a diagram illustrating the attached and adjusted state of the light reception side, as viewed from the side perpendicular to the light beam LB. FIG. 17 is a diagram illustrating the attached and adjusted state of the light reception side, as viewed from the light emission side. When the ink droplet detecting device 20 is attached to the optical axis adjusting device 55, a lower receiving portion 45*h* and an upper corner portion 45*g* of the light receiving element holder 45 protruding from the light-reception-side module cover 33 are vertically interposed between the vertical adjustment jigs 52 in parallel to the light-reception-side holder shaft portion 45*c*. The light-reception-side holder shaft portion 45*c* is fitted to the light-reception-side positioning hole 35 and the guide protrusion 45*e* is fitted to the guide groove 39. In this way, the light receiving module is held such that the sliding thereof in the vertical direction is adjusted. As described above, after sliding is adjusted, a plurality of fastening members 49 is fastened to fix the light receiving module 32 to the base member 28.

Then, as shown in FIG. 15, the light emitting element 41 receives power from a power supply (not shown) that is provided inside or outside the optical axis adjusting device 55 and emits light (see Step S2). In addition, a detecting circuit of the position adjusting light receiving element 56, which will be described below, is supplied with power and is turned on (see Step S3). Then, the rotation adjusting jig 50 is rotated and the light emitting element holder 40 is rotated (see Step S4). It is determined whether the output value of the position adjusting light receiving element 56 is equal to or more than an appropriate value (see Step S5).

When the output value is equal to or more than the appropriate value, wait until the output value reaches the maximum value (see Step S6), and then it is detected that the light beam LB formed by the light emitted from the light emitting element 41 is incident on the positioning target 54 which is provided in the light receiving element 46 for detecting a discharge failure from the output value of the position adjusting light receiving element 56. After adjustment, the fastening member 48 is fastened to duly fix the light emitting element holder 40 to the base member 28 (see Step S7). Then, the detecting circuit of the position adjusting light receiving element 56 is turned off (see Step S8). Then, the process proceeds to a nozzle level adjusting step shown in FIG. 18.

When the output value of the position adjusting light receiving element 56 is equal to or less than the appropriate value, it is determined whether adjustment is performed in the entire rotation adjustment range (see Step S9). When it is determined that adjustment is not performed in the entire rotation adjustment range, the process returns to Step S4, and the rotation adjusting jig 50 is rotated by a predetermined angle and the light emitting element holder 40 is rotated. On the other hand, when it is determined that adjustment is performed in the entire rotation adjustment range, it is determined whether adjustment is performed in the entire vertical adjustment range (see Step S10). When it is determined that adjustment is not performed in the entire vertical adjustment range, the vertical adjustment jig 52 is moved a predetermined distance in the vertical direction (see Step S11), and the process returns to Step S4. Similarly, the rotation adjusting jig 50 is rotated and the light emitting element holder 40 is rotated. On the other hand, when it is determined that adjustment is performed in the entire vertical adjustment range, an error is displayed (see Step S12) and the process ends. That is, when the incidence of light on the positioning target 54 is not detected from the output value of the position adjusting light receiving element 56 even though the light emitting element holder 40 is rotated, the light receiving element holder 45 slides in the vertical direction such that the height thereof is adjusted, and the light emitting element holder 40 is rotated again. The adjustment of the height of the light receiving element holder 45 and the adjustment of the rotation of the light emitting element holder 40 are repeated until the light beam LB is incident on the positioning target 54.

Figure 18:
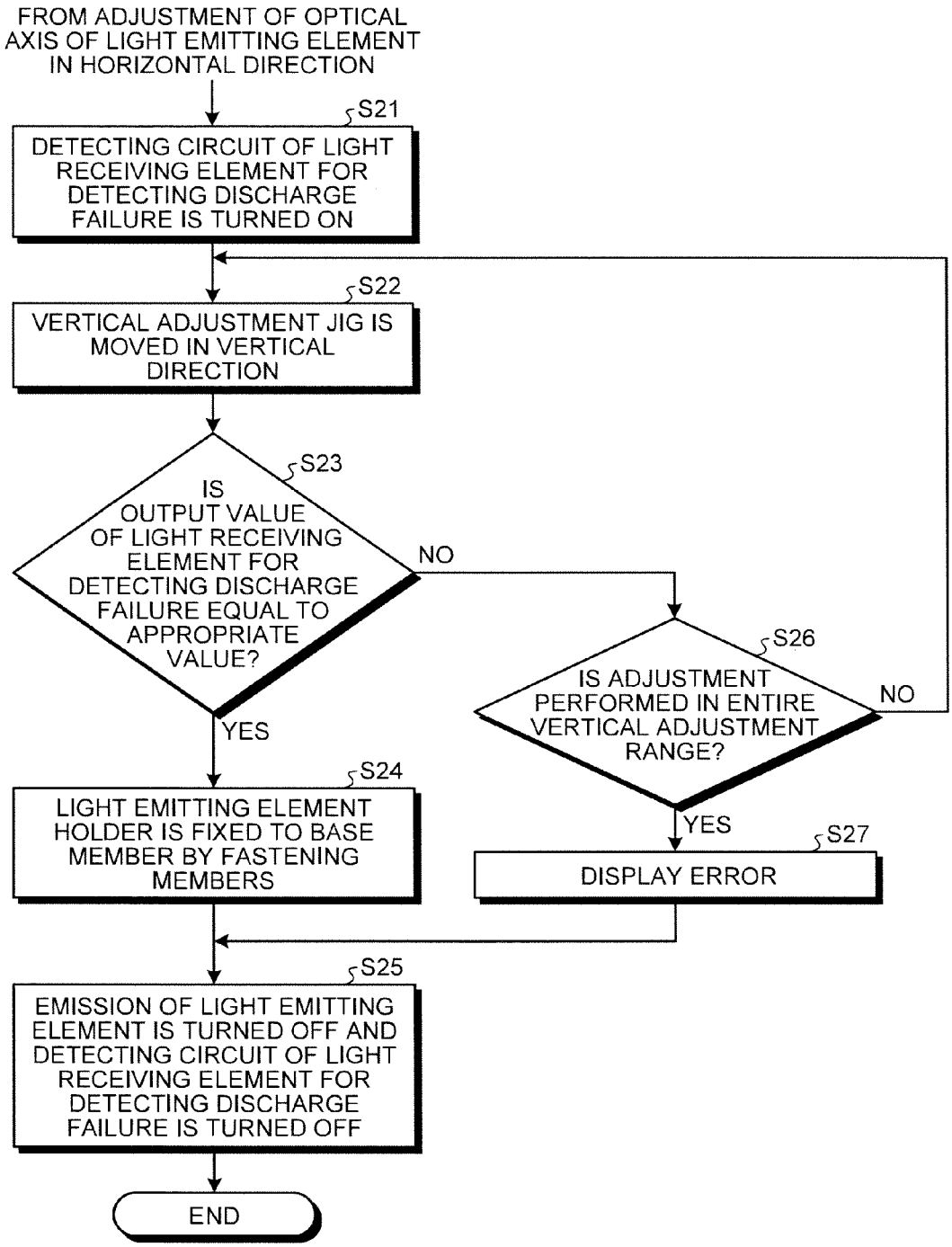
FIG. 18 is a flowchart illustrating a process of adjusting the optical axis of a light receiving element for detecting a discharge failure in the vertical direction.

FIG. 18 is a flowchart illustrating a process of adjusting the optical axis of the light receiving element 46 for detecting a discharge failure in the vertical direction, that is, a nozzle level adjusting process. After the adjustment of the optical axis of the light emitting element 41 in the horizontal direction ends and the light emitting element holder 40 is duly fixed to the base member 28, the detecting circuit of the light receiving element 46 for detecting a discharge failure is turned on (see Step S21), and the vertical adjustment jig 52 is moved in the vertical direction to slide the light receiving element holder 45 such that the height thereof is adjusted (see Step S22). Then, it is determined whether the output value of the light receiving element 46 for detecting a discharge failure is equal to or more than an appropriate value (see Step S23).

When the output value is equal to the appropriate value, the fastening members 49 are fastened to fix the light receiving element holder 45 to the base member 28 (see Step S24). Then, the emission of light by the light emitting element 41 is turned off, and the detecting circuit of the light receiving element 46 for detecting a discharge failure is turned off (Step S25). Then, the process ends.

When the output value of the light receiving element 46 for detecting a discharge failure is not equal to the appropriate value, it is determined whether adjustment is performed in the entire vertical adjustment range (see Step S26). When it is determined that adjustment is not performed in the entire vertical adjustment range, the process returns to Step S22. Similarly, the vertical adjustment jig 52 is moved a predetermined distance in the vertical direction and the light receiving element holder 45 slides such that the height thereof is adjusted. The adjustment of the height of the light receiving element holder 45 is repeated until the output value of the light receiving element 46 for detecting a discharge failure is equal to the appropriate value. On the other hand, when it is determined that adjustment is performed in the entire vertical adjustment range, an error is displayed (see Step S27). Then, the emission of light by the light emitting element 41 is turned off and the detecting circuit of the light receiving element 46 for detecting a discharge failure is turned off (see Step S25). Then, the process ends.

Figure 19:
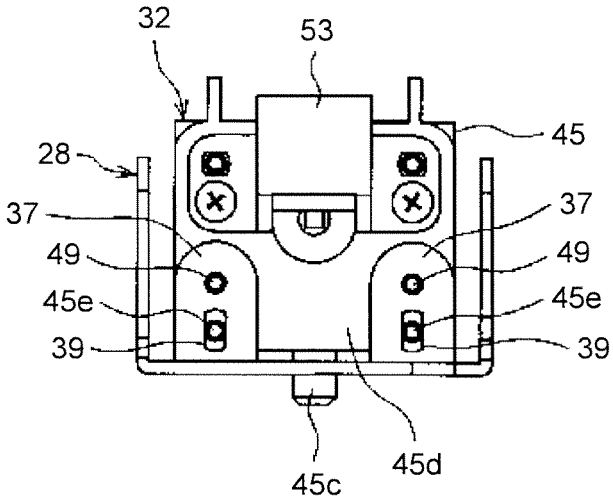
FIG. 19 is a diagram illustrating the attachment of the light receiving module to the base member, as viewed from the light emitting module.

FIG. 19 is a diagram illustrating the attachment of the light receiving module 32 to the base member 28, as viewed from the light emitting module 30. As shown in FIG. 19, the guide protrusion 45*e* formed on the sliding surface 45*d* of the light receiving element holder 45 is fitted to the guide groove 39 provided in the vertically bent piece 37 of the base member 28, and the sliding surface 45*d* of the light receiving element holder 45 comes into contact with the guide surface 38 of the vertically bent piece 37 of the base member 28 such that the movement of the light receiving element holder 45 is guided. After the sliding of the light receiving module 32 in the vertical direction is adjusted, the light receiving module 32 is fixed to the base member 28 by a plurality of fastening members 49.

The optical axis adjusting device 55 includes a control unit that controls one or both of the rotation adjusting jig 50 and the vertical adjustment jig 52 on the basis of the output value of the position adjusting light receiving element 56. The optical axis adjusting device 55 controls the two jigs 50 and 52 on the basis of the detected output of the position adjusting light receiving element 56 to automatically adjust the optical axis of the ink droplet detecting device 20. In this way, it is possible to improve work efficiency and stabilize the detection performance.

In the above-mentioned example, the position adjusting light receiving element 56 that receives light which has been emitted from the light emitting element 41 and then reflected from the reflecting surface 54*a* is provided in the optical axis adjusting device 55 separately from the light receiving element 46 for detecting a discharge failure. However, the light receiving element 46 for detecting a discharge failure may also be used as the position adjusting light receiving element 56.

Figure 20A:
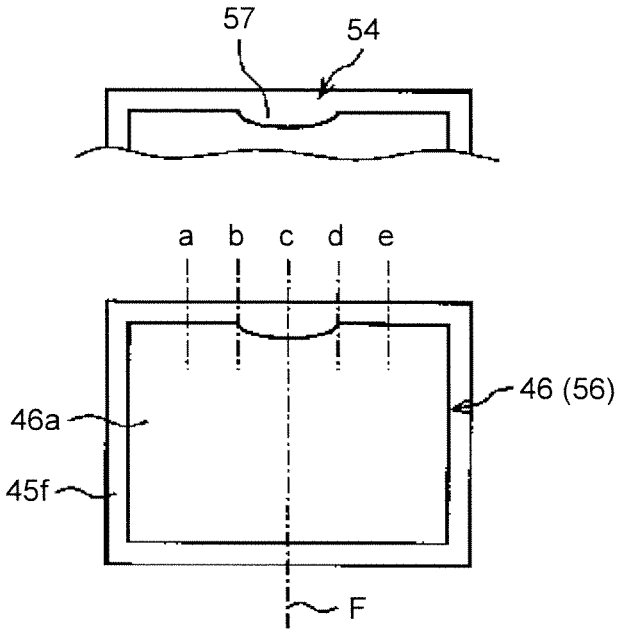
FIG. 20A is a diagram illustrating a case in which a light shielding shape is formed as the positioning target in a cut-out portion around a light receiving surface of the light receiving element for detecting a discharge failure so as to protrude toward the light receiving surface.
Figure 20B:
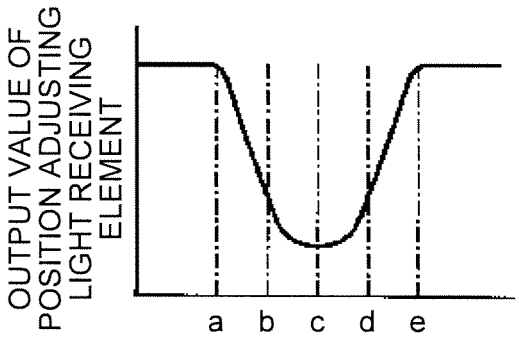
FIG. 20B is a diagram illustrating a variation in the output value of the position adjusting light receiving element at the positions a to e shown in FIG. 20A.
Figure 21A:
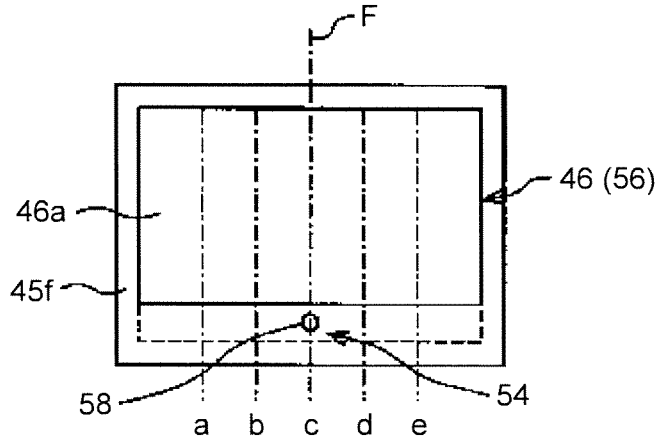
FIG. 21A is a diagram illustrating a case in which a through hole is formed as the positioning target in the cut-out portion around the light receiving surface of the light receiving element for detecting a discharge failure.

FIGS. 20A, 20B, 21A, and 21B show an example in which the light receiving element 46 for detecting a discharge failure is also used as the position adjusting light receiving element 56. FIG. 20A shows a case in which a light shielding shape 57 that protrudes toward the light receiving surface 46*a* is formed as the positioning target 54 on the cut-out portion 45*f* provided around the light receiving surface 46*a* of the light receiving element 46 for detecting a discharge failure. FIG. 21A is a diagram illustrating a case in which a through hole 58, such as a via hole, is formed.

The light shielding shape 57 is formed on the vertical plane F of the light receiving element holder 45 that passes through the center axis of the light receiving element 46 for detecting a discharge failure and the light-reception-side holder shaft portion 45*c* as described above so as to cover the light receiving element 46 for detecting a discharge failure. In this way, the light shielding shape 57 prevents light emitted from the light emitting element 41 from being directly incident on the light receiving element 46 for detecting a discharge. The through hole 58 is formed on the vertical plane F of the light receiving element holder 45 that passes through the center axis of the light receiving element 46 for detecting a discharge failure such that light emitted from the light emitting element 41 passes through the through hole 58 and is directly incident on the light receiving element 46 for detecting a discharge failure.

Figure 21B:
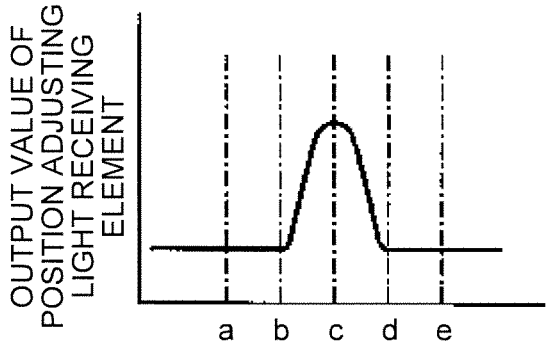
FIG. 21B is a diagram illustrating a variation in the output value of the position adjusting light receiving element at the positions a to e shown in FIG. 21A.

FIGS. 20A and 21A are diagrams illustrating a variation in the position of the light beam LB from a to e when the light emitting element 41 is rotated in the horizontal direction, and FIGS. 20B and 21B are diagrams illustrating a variation in the output value of the position adjusting light receiving element 56 at the positions a to e. In FIG. 20B, when the light emitting element 41 is rotated in the horizontal direction and the light beam LB is at the position c, the light beam LB is incident on the light shielding shape 57 and is prevented from being received by the light receiving element 46 for detecting a discharge failure, and the output value of the position adjusting light receiving element 56 is the minimum. Therefore, it is possible to detect that the light beam LB is incident on the positioning target 54. In FIG. 21B, when the light emitting element 41 is rotated in the horizontal direction and the light beam LB is at the position c, the light beam LB passes through the through hole 58 and is received by the light receiving element 46 for detecting a discharge failure, and the output value of the position adjusting light receiving element 56 is the maximum. Therefore, it is possible to detect that the light beam LB is incident on the positioning target 54.

Figure 22A:
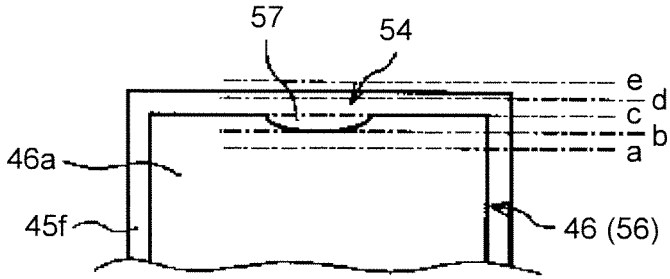
FIG. 22A is a diagram illustrating a variation in the position of a light beam from a to e when the light receiving element for detecting a discharge failure is moved in the vertical direction in the structure shown in FIG. 20A.
Figure 22B:
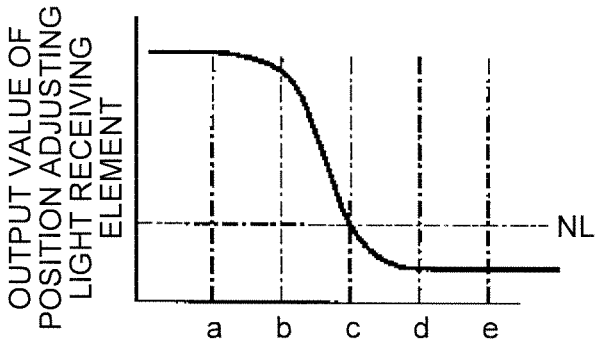
FIG. 22B is a diagram illustrating a variation in the output value of the position adjusting light receiving element at the positions a to e shown in FIG. 22A.

FIG. 22A is a diagram illustrating a case in which, in the structure shown in FIG. 20A, the light receiving element 46 for detecting a discharge failure is moved in the vertical direction and the position of the light beam LB is changed from a to e. FIG. 22B is a diagram illustrating a variation in the output value of the position adjusting light receiving element 56 at the positions a to e. The output value of the position adjusting light receiving element 56 is the minimum at the position between c and d. In the actual scattered light detecting method, when the light beam LB is incident between the positions c and d, it is possible to detect scattered light with high efficiency. When the noise level NL of the light is experimentally calculated from the cross section of a beam and the shape of a target, it is possible to easily perform adjustment.

Figure 23:
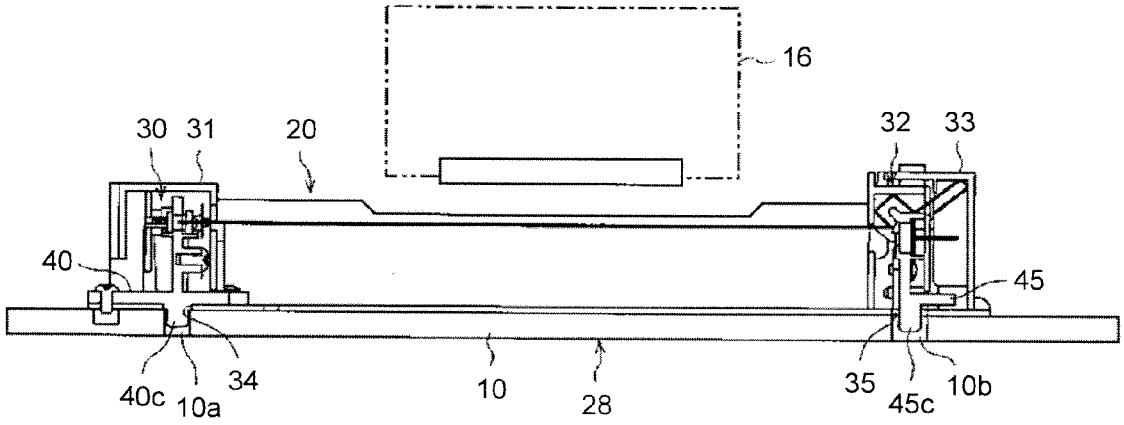
FIG. 23 is a diagram illustrating a state in which the ink droplet detecting device is positioned at a light-emission-side positioning position and a light-reception-side positioning position and is attached to a housing of an ink jet recording apparatus body.

FIG. 23 shows a state in which the ink droplet detecting device 20 is positioned at a light-emission-side positioning position and a light-reception-side positioning position and is attached to the housing 10 of the ink jet recording apparatus body. The light emitting module 30 and the light receiving module 32 are attached to the base member 28 and the module covers 31 and 33 are placed thereon. After the angle is adjusted, the light-emission-side holder shaft portion 40*c* passing through the light-emission-side positioning hole 34 and the light-reception-side holder shaft portion 45*c* passing through the light-reception-side positioning hole 35 are fitted to positioning shaft holes 10*a* and 10*b*, respectively, thereby attaching the ink droplet detecting device 20 to the housing 10 of the ink jet recording apparatus body, as shown in FIG. 23.

The positioning shaft hole 10*a* has a circular shape to which the light-emission-side holder shaft portion 40*c* is tightly fitted, and the positioning shaft hole 10*b* has an oval shape with the major axis extending in the direction of the positioning shaft hole 10*a*.

INDUSTRIAL APPLICABILITY

As described above, a method of adjusting the optical axis of an ink droplet detecting device, an assembly method of an ink droplet detecting device, and an optical axis adjusting device according to the invention are useful for an ink jet recording apparatus body, such as a printer, a copier, or a facsimile, and are particularly suitable to adjust the optical axis between a light emitting element and a light receiving element of an ink droplet detecting device.

REFERENCE SIGNS LIST

10 HOUSING
10*a* POSITIONING SHAFT HOLE
10*b* POSITIONING SHAFT HOLE
15 CARRIAGE
16 INK DROPLET DISCHARGE HEAD
16*a* HEAD NOZZLE PLANE
16*y*, 16*c*, 16*m*, 16*b* INK DROPLET DISCHARGE HEAD
20 INK DROPLET DETECTING DEVICE
28 BASE MEMBER
30 LIGHT EMITTING MODULE
31 LIGHT-EMISSION-SIDE MODULE COVER
32 LIGHT RECEIVING MODULE
33 LIGHT-RECEPTION-SIDE MODULE COVER
34 LIGHT-EMISSION-SIDE POSITIONING HOLE
35 LIGHT-RECEPTION-SIDE POSITIONING HOLE
36 OPENING
37 BENT PIECE
38 GUIDE SURFACE
39 GUIDE GROOVE
40 LIGHT EMITTING ELEMENT HOLDER
40*c* LIGHT-EMISSION-SIDE HOLDER SHAFT PORTION
40*d* JIG FITTING PORTION
40*e* PROTRUDING PORTION
41 LIGHT EMITTING ELEMENT
45 LIGHT RECEIVING ELEMENT HOLDER
45*c* LIGHT-RECEPTION-SIDE HOLDER SHAFT PORTION
45*d* SLIDING SURFACE
45*e* GUIDE PROTRUSION
45*f* CUT-OUT PORTION
45*g* UPPER CORNER PORTION
45*h* LOWER RECEIVING PORTION
46 LIGHT RECEIVING ELEMENT FOR DETECTING DISCHARGE FAILURE
46*a* LIGHT RECEIVING SURFACE
47 CIRCUIT BOARD
48 FASTENING MEMBER
49 FASTENING MEMBER
50 ROTATION ADJUSTING JIG
51 ROTATING BODY
52 VERTICAL ADJUSTMENT JIG
53 LIGHT GUIDE COVER
53*a* INCLINED SURFACE
54 POSITIONING TARGET
54*a* REFLECTING SURFACE
55 OPTICAL AXIS ADJUSTING DEVICE
56 POSITION ADJUSTING LIGHT RECEIVING ELEMENT
57 LIGHT SHIELDING SHAPE
58 LIGHT TRANSMITTING SHAPE
F VERTICAL PLANE PASSING THROUGH CENTER AXIS OF LIGHT RECEIVING ELEMENT 46 FOR DETECTING DISCHARGE FAILURE
L OPTICAL AXIS OF LIGHT BEAM LB
N1, N2, . . . , Nx, . . . , Nn NOZZLE
P INK DROPLET
LB LIGHT BEAM
NL NOISE LEVEL
S, S1, S2, . . . SCATTERED LIGHT

The invention claimed is:

1. A method of adjusting the optical axis of an ink droplet detecting device, the ink droplet detecting device including a light emitting element that emits light, a light emitting element holder that holds the light emitting element and includes a light-emission-side holder shaft portion, a light receiving element for detecting an ink droplet discharge failure that receives scattered light after a light beam formed by the light emitted from the light emitting element collides with an ink droplet, a light receiving element holder that holds the light receiving element and includes a light-reception-side holder shaft portion, and a base member to which the light emitting element holder and the light receiving element holder are preliminarily positioned by the light-reception-side holder shaft portion and the light-emission-side holder shaft portion and then fixed, the light emitting element holder being held to the base member such that the rotation of the light emitting element holder about the light-emission-side holder shaft portion can be adjusted and the light receiving element holder being held to the base member such that the sliding of the light receiving element holder in the axial direction of the light-reception-side holder shaft portion perpendicular to a direction in which the rotation of the light emitting element holder is adjusted can be adjusted, the method comprising:

positioning the ink droplet detecting device with the light-emission-side holder shaft portion and the light-reception-side holder shaft portion and fixing the ink droplet detecting device to an optical axis adjusting device;

supplying power to turn on the emission of the light emitting element and a detecting circuit of a position adjusting light receiving element;

rotating the light emitting element holder, and detecting that the light beam formed by the light which is emitted from the light emitting element is incident on a positioning target provided in the light receiving element for detecting a discharge failure, from an output value of the position adjusting light receiving element;

duly fixing the light emitting element holder to the base member; and when the incidence of the light beam on the positioning target is not detected from the output value of the position adjusting light receiving element even though the light emitting element holder is rotated, sliding the light receiving element holder to adjust the height of the light receiving element holder, rotating the light emitting element holder again, and repeating the adjustment of the height of the light receiving element holder and the adjustment of the rotation of the light emitting element holder until the light beam is incident on the positioning target.

2. The method of adjusting the optical axis of an ink droplet detecting device according to claim 1, further comprising after the light emitting element holder is duly fixed to the base member, turning the detecting circuit of the light receiving element for detecting a discharge failure on, causing the light receiving element holder to slide such that the height thereof is adjusted, and determining whether the output value of the light receiving element for detecting a discharge failure is an appropriate value, on determining that the output value is the appropriate value, duly fixing the light receiving element holder to the base member, and on determining that the output value is not the appropriate value, causing the light receiving element holder to slide again such that the height thereof is adjusted, and repeating the adjustment of the height of the light receiving element holder until the output value of the light receiving element for detecting a discharge failure is the appropriate value.

3. The method of adjusting the optical axis of an ink droplet detecting device according to claim 1, wherein the light receiving element for detecting a discharge failure is used as the position adjusting light receiving element, and a light shielding shape that covers the light receiving element for detecting a discharge failure and prevents the light emitted from the light emitting element from being directly incident on the light receiving element for detecting a discharge failure is formed as the positioning target on a vertical plane of the light receiving element holder which passes through the center axis of the light receiving element for detecting a discharge failure.

4. The method of adjusting the optical axis of an ink droplet detecting device according to claim 1, wherein the light receiving element for detecting a discharge failure is used as the position adjusting light receiving element, and a light transmitting shape that transmits the light emitted from the light emitting element so as to be directly incident on the light receiving element for detecting a discharge failure is formed as the positioning target on a vertical plane of the light receiving element holder which passes through the center axis of the light receiving element for detecting a discharge failure.

5. The method of adjusting the optical axis of an ink droplet detecting device according to claim 1, wherein the positioning target has a reflecting surface that is provided on the vertical plane of the light receiving element holder passing through the center axis of the light receiving element for detecting a discharge failure, and the position adjusting light receiving element that receives light which has been emitted from the light emitting element and then reflected from the reflecting surface is provided in the optical axis adjusting device separately from the light receiving element for detecting a discharge failure.

6. A method of assembling an ink droplet detecting device, the ink droplet detecting device including a light emitting element that emits light, a light emitting element holder that holds the light emitting element and includes a light-emission-side holder shaft portion, a light receiving element for detecting an ink droplet discharge failure that receives scattered light after a light beam formed by the light emitted from the light emitting element collides with an ink droplet, a light receiving element holder that holds the light receiving element and includes a light-reception-side holder shaft portion, and a base member to which the light emitting element holder and the light receiving element holder are preliminarily positioned by the light-reception-side holder shaft portion and the light-emission-side holder shaft portion and then fixed, the light emitting element holder being held to the base member such that the rotation of the light emitting element holder about the light-emission-side holder shaft portion can be adjusted and the light receiving element holder being held to the base member such that the sliding of the light receiving element holder in the axial direction of the light-reception-side holder shaft portion perpendicular to a direction in which the rotation of the light emitting element holder is adjusted can be adjusted, the method comprising:

inserting a light-emission-side holder shaft portion and a light-reception-side holder shaft portion into shaft holes of an ink jet recording apparatus body and positioning the ink droplet detecting device;

adjusting the optical axis of the ink droplet detecting device by positioning the ink droplet detecting device with the light-emission-side holder shaft portion and the light-reception-side holder shaft portion and fixing the ink droplet detecting device to an optical axis adjusting device;

supplying power to turn on the emission of the light emitting element and a detecting circuit of a position adjusting light receiving element;

rotating the light emitting element holder, and detecting that the light beam formed by the light which is emitted from the light emitting element is incident on a positioning target provided in the light receiving element for detecting a discharge failure, from an output value of the position adjusting light receiving element;

duly fixing the light emitting element holder to the base member; and when the incidence of the light beam on the positioning target is not detected from the output value of the position adjusting light receiving element even though the light emitting element holder is rotated, sliding the light receiving element holder to adjust the height of the light receiving element holder, rotating the light emitting element holder again, and repeating the adjustment of the height of the light receiving element holder and the adjustment of the rotation of the light emitting element holder until the light beam is incident on the positioning target; and assembling to the recording apparatus body, the ink droplet detecting device.

7. An apparatus for adjusting the optical axis of an ink droplet detecting device, the ink droplet detecting device including a light emitting element that emits light, a light emitting element holder that holds the light emitting element and includes a light-emission side holder shaft portion, a light receiving element for detecting an ink droplet discharge failure that receives scattered light after the light emitted from the light emitting element collides with an ink droplet, a light receiving element holder that holds the light receiving element and includes a light-reception-side holder shaft portion, and a base member to which the light emitting element and the light receiving element for detecting a discharge failure are positioned by the light-reception-side holder shaft portion and a light-emission-side holder shaft portion and then fixed, the light emitting element holder being held to the base member such that the rotation of the light emitting element holder about the light-emission-side holder shaft portion can be adjusted and the light receiving element holder being held to the base member such that the sliding of the light receiving element holder in the axial direction of the light-reception-side holder shaft portion perpendicular to a direction in which the rotation of the light emitting element holder is adjusted can be adjusted, the apparatus comprising:

an installation position where the ink droplet detecting device is positioned by the light-emission-side holder shaft portion and the light-reception-side holder shaft portion and is fixed;

a rotation adjusting jig that adjusts the rotation of the light emitting element holder about the light-emission-side holder shaft portion relative to the base member;

a vertical adjustment jig that adjusts the sliding of the light receiving element holder relative to the base member in the axial direction of the light-reception-side holder shaft portion perpendicular to the direction in which the rotation of the light emitting element holder is adjusted; and a position adjusting light receiving element which detects that the light emitted from the light emitting element after the light emitting element holder is rotated is incident on a positioning target provided in the light receiving element from an output value.

8. The apparatus for adjusting the optical axis of an ink droplet detecting device according to claim 7, further comprising:

a control unit that controls one or both of the rotation adjusting jig and the vertical adjustment jig on the basis of the output value of the position adjusting light receiving element.

* * * * *